US007549632B2

(12) United States Patent
Kojima et al.

(10) Patent No.: US 7,549,632 B2
(45) Date of Patent: Jun. 23, 2009

(54) PAPER FEED TRAY AND PRINTER FURNISHED WITH THE TRAY

(75) Inventors: Yasushi Kojima, Nishinomiya (JP); Shuichi Arimura, Daito (JP); Kenichi Furunaga, Osaka (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 102 days.

(21) Appl. No.: 10/863,778

(22) Filed: Jun. 9, 2004

(65) Prior Publication Data

US 2004/0251599 A1 Dec. 16, 2004

(30) Foreign Application Priority Data

Jun. 10, 2003 (JP) ..... 2003-164525
Aug. 28, 2003 (JP) ..... 2003-304447

(51) Int. Cl.
*B65H 1/12* (2006.01)

(52) U.S. Cl. ..... 271/160; 221/287

(58) Field of Classification Search ..... 271/145, 271/147, 160, 171; 221/287, 197, 198
See application file for complete search history.

(56) References Cited

U.S. PATENT DOCUMENTS 5,120,044 A * 6/1992 Ettischer et al. ..... 271/127
5,752,696 A * 5/1998 Nakatani et al. ..... 271/127

FOREIGN PATENT DOCUMENTS

| | | |
|---|---|---|
| JP | 56-137157 | 10/1981 |
| JP | 58-069646 | 4/1983 |
| JP | 59-156033 | 10/1984 |
| JP | 59-227637 | * 12/1984 |
| JP | 63-166539 | 10/1988 |
| JP | 64-17723 | * 1/1989 |
| JP | 01-156235 | 6/1989 |
| JP | 05-319588 | 12/1993 |
| JP | 8-244995 | 9/1996 |
| JP | 10-194477 | 7/1998 |
| JP | 2001-253557 | 9/2001 |
| JP | 2002-12329 | 1/2002 |
| JP | 2002-19975 | 1/2002 |

* cited by examiner

*Primary Examiner*—Patrick H Mackey
*Assistant Examiner*—Thomas A Morrison
(74) *Attorney, Agent, or Firm*—Kratz, Quintos & Hanson, LLP

(57) ABSTRACT

A paper feed tray includes: a tray unit; a lifting member arranged in the tray unit, for lifting a drawn-out end of a paper sheet being the uppermost or the last of a stack accommodated in the tray unit; a spring for urging the lifting member in a lifting direction; and a lid attachable to and pivotable on the tray unit and having a free end near where paper sheets are drawn out. The inner face of the lid is furnished with a plurality of protruding parts capable of pressing on a paper sheet accommodated in the tray unit is arranged on the inner face of the lid at intervals from the pivotal-axis side toward the free-end side of the lid. The heights of the protruding parts decrease in order of proximity to the free-end side of the lid, so that while the lid is being closed the protruding parts, in order from the one closest to the pivotal axis of the lid, press on the paper sheet.

5 Claims, 11 Drawing Sheets

FIG. 11 (a) PRIOR ART
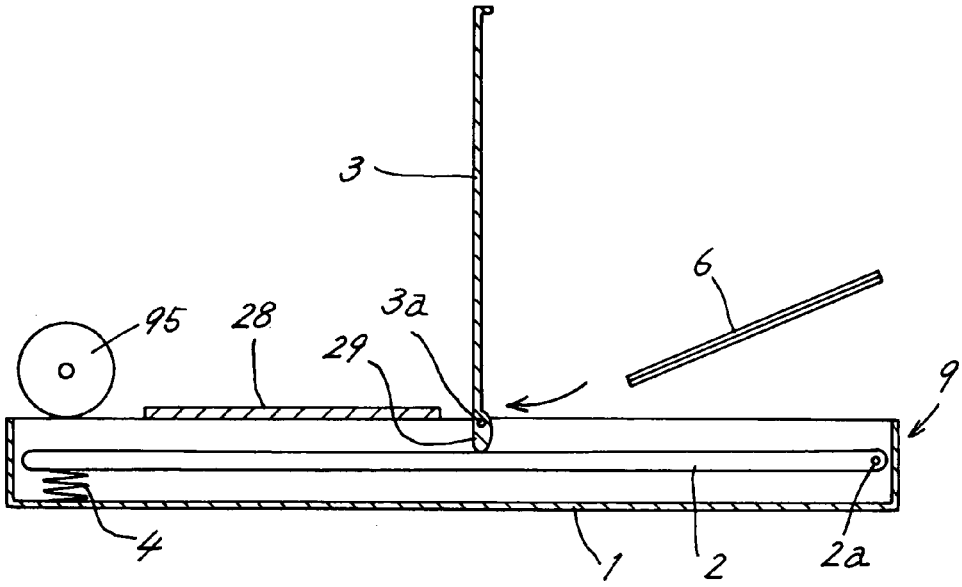
FIG. 11 (b) PRIOR ART
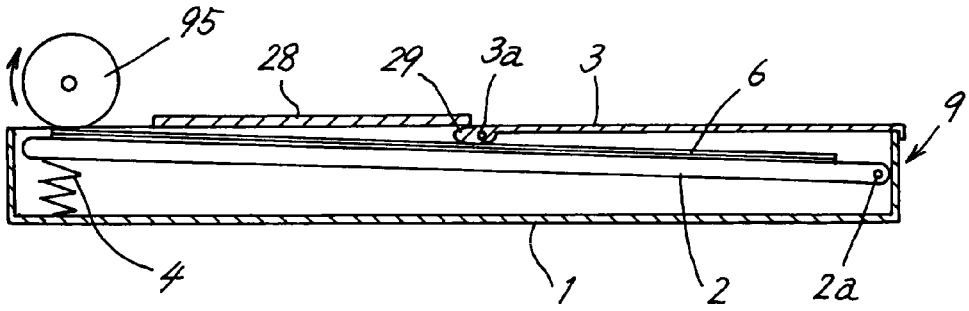

FIG. 12 (a) PRIOR ART
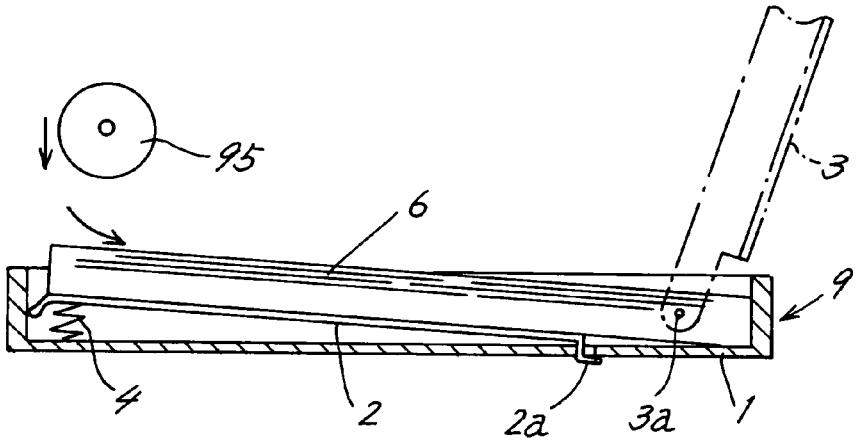
FIG. 12 (b) PRIOR ART
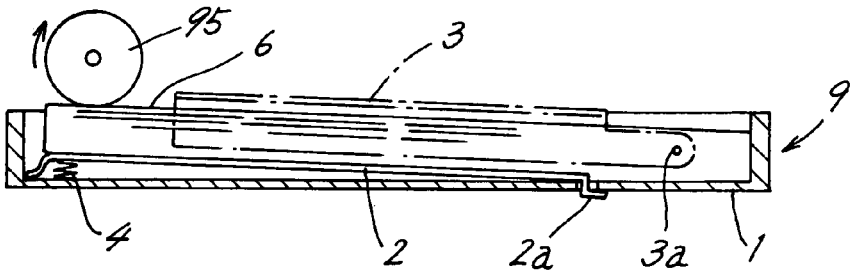
FIG. 13 PRIOR ART
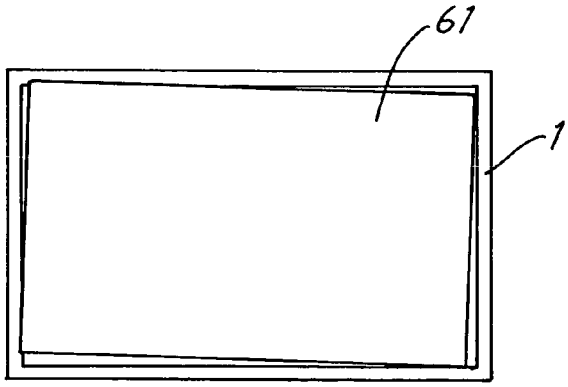

PAPER FEED TRAY AND PRINTER FURNISHED WITH THE TRAY

BACKGROUND OF THE INVENTION

1. Field of the Invention

The present invention relates to paper feed trays furnished inside with a mechanism for lifting a paper stack, and to printers furnished with the tray.

2. Description of Related Art

Paper feed trays are installed in a printer for printing images or the like and feed paper sheets to the printer. FIGS. 11(*a*) and 11(*b*) are cross-sectional side views of a conventional paper feed tray 9 (see Japanese Laid-Open Pat. App. Pub. No. 2002-19975). In this tray, one end of a lifting member 2, on which a paper stack 6 is placed, is supported at a pivot 2*a* in a tray unit 1. The lifting member 2 is urged upward with a spring 4 at the opposite end to the pivot part 2*a*. In a printer, a roller 95 is furnished above the spring 4, for pulling out paper sheets from the tray unit 1. In the following description, frontward is the direction in which paper sheets are drawn out, and rearward is the opposite.

One end of a lid 3 is supported at a pivot 3*a* in a mid portion between the front and the rear of the tray unit 1, and a hold-down protuberance 29 protrudes near the pivot part 3*a*. The upper opening of the tray unit 1 is covered by a cover 28 except for the portion into which the roller 95 is inserted and the portion that the lid 3 covers.

To insert the paper stack 6 into the tray unit 1, the lid 3 is opened by pivoting it with the pivot 3*a* being the center, as illustrated in FIG. 11(*a*). The hold-down protuberance 29 lowers the lifting member 2 against the urging force of the spring. A gap is created between the upper face of the tray unit 1 and the lifting member 2, and the paper stack 6 is inserted into the gap. As illustrated in FIG. 11(*b*), the hold-down protuberance 29 comes off of the lifting member 2 as the lid 3 is closed, and the lifting member 2 moves upward. The roller 95 comes into contact with the uppermost paper sheet in the paper stack 6, and rotation of the roller 95 transfers the paper sheet from the tray unit 1.

Because the paper feed tray 9 illustrated in FIGS. 11(*a*) and 11(*b*) has the cover 28, which sits over the upper opening of the tray unit 1, supplying of the paper stack 6 into the tray is difficult. In view of this, there is another configuration as illustrated in FIGS. 12(*a*) and 12(*b*), in which a lid 3 is supported at a pivot 3*a* in one side of the tray unit 1 so that the entire upper opening of the tray unit 1 can be exposed. The lifting member 2 is supported at a pivot 2*a* on the lower face of the tray unit 1, and a paper stack 6 is inserted from a roller 95 side. The roller 95 is arranged so that it can move up and down. The urging force of a spring 4 exceeds the weight of the paper stack 6, and by closing the lid 3, the paper stack 6 is pushed against the lid 3. The roller 95 lowers, and the uppermost paper sheet comes into contact with the roller 95.

The tray illustrated in FIGS. 12(*a*) and 12(*b*) has the following problem. As seen in FIG. 12(*a*), the uppermost paper sheet juts out of the upper plane of the tray unit 1 in a state in which the paper stack 6 is placed on the lifting member 2. Therefore, if an unexpected force is exerted to the tray unit 1 while the lid 3 is being closed, an uppermost paper sheet 61 will become misaligned and juts out over a side wall of the tray unit 1, as illustrated in FIG. 13. As a result, a drawn-out end of the paper sheet 61 may not come into contact with the roller 95 properly, leading to failure of sheet feeding. In particular, the user often does not notice misalignment of the uppermost paper sheet while the lid 3 is being closed.

It is an object of the present invention to provide a paper feed tray that prevents paper sheets from being misaligned while the lid 3 is being closed.

BRIEF SUMMARY OF THE INVENTION

A paper feed tray 9 is furnished with a lid 3 attachable to and pivotable on a tray unit 1 and having a free end near where paper sheets are drawn out, and the lid 3 has a protruding part 34 formed on its inner face, for pushing the paper sheet interiorly into the tray unit 1 while the lid 3 is being closed.

While the lid 3 is being closed, the protruding part 34 on the lid 3 holds down a paper stuck 6 tilted by a lifting member 2.

Since the protruding part 34 is located near the pivotal axis of the lid 3, it pushes a portion of the paper stack 6 that has fitted in the tray unit 1. Thus, the paper stack 6 is kept pressed, and therefore, the position of the uppermost paper sheet is not misaligned even when the tray unit 1 receives an unexpected force while the lid 3 is being closed.

BRIEF DESCRIPTION OF THE DRAWINGS

FIGS. 11(*a*) and 11(*b*) are cross-sectional side views of a conventional paper feed tray;

FIGS. 12(*a*) and 12(*b*) are cross-sectional side views of another conventional paper feed tray; and FIG. 13 is a plan view illustrating a state in which the positions of paper sheets in a tray unit are misaligned.

DETAILED DESCRIPTION OF THE PREFERRED EMBODIMENTS

First Embodiment

Outline of the Printer

Figure 1:
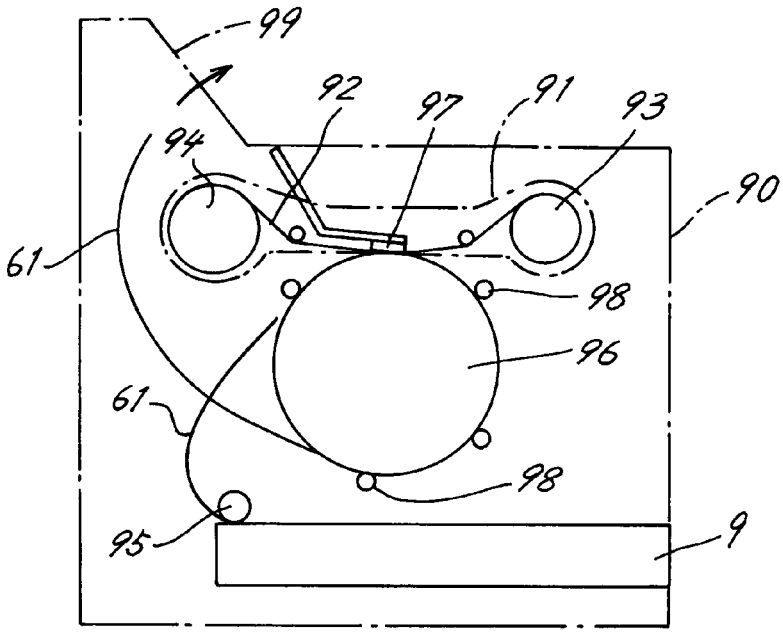
FIG. 1 is a schematic view of a printer to which a paper feed tray is mounted.

FIG. 1 is a schematic view showing a printer 90 to which a paper feed tray 9 according to the present invention is mounted. In the printer 90, the paper feed tray 9 and a cartridge 91 are mounted detachably/reattachably. The cartridge 91 is furnished inside with a supply roller 93 around which an ink sheet 92 is wound, and a take-up roller 94 that winds up the ink sheet 92.

When printing, an uppermost paper sheet 61 in the paper feed tray 9 is drawn out by a roller 95 one by one and wound around a platen roller 96. With the platen roller 96 being rotated, the ink sheet 92 is transferred by the take-up roller 94 while being heated with a thermal head 97, so that image data of yellow, magenta, and cyan are successively printed on the paper sheet 61. Upon completing the printing, the paper sheet 61 is ejected by a transfer roller 98 from an ejection part 99 formed on the upper end of the printer 90.

Paper Feed Tray

Figure 2:
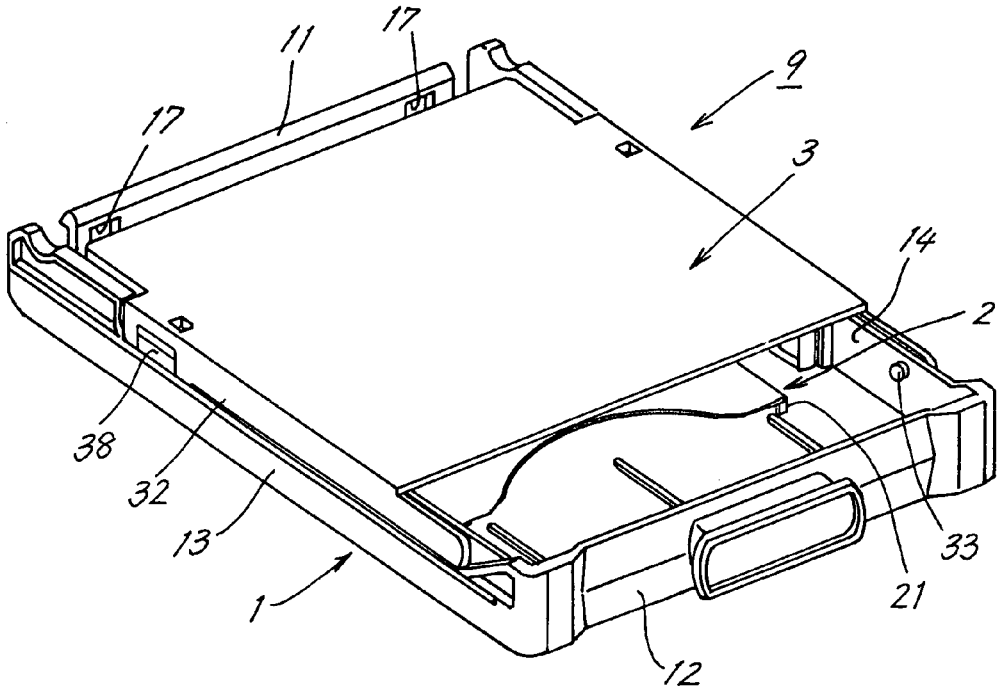
FIG. 2 is a perspective view of the paper feed tray.
Figure 3:
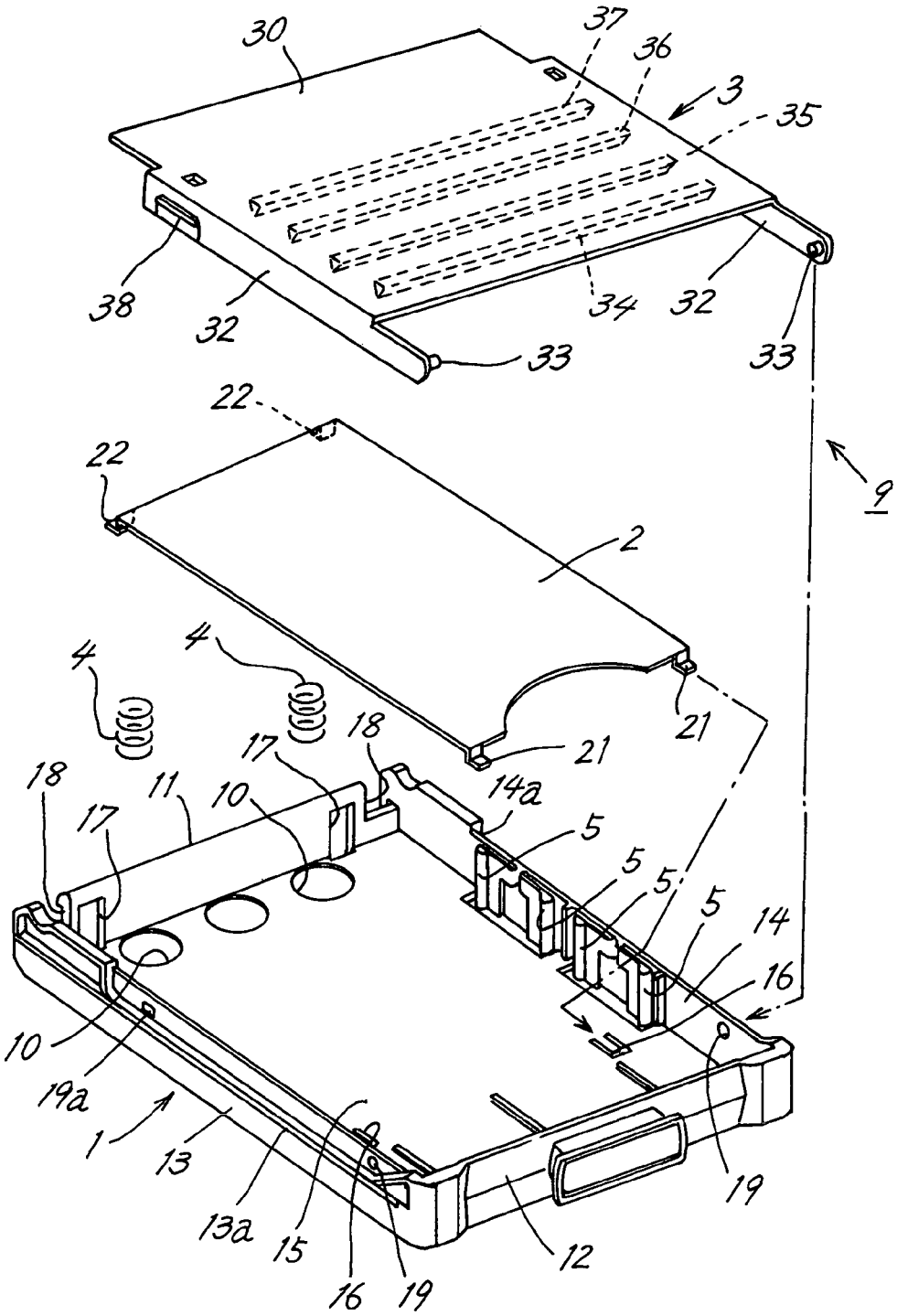
FIG. 3 is an exploded perspective view of the paper feed tray.

FIG. 2 is a perspective view of the paper feed tray 9, and FIG. 3 is an exploded perspective view thereof. The paper feed tray 9 comprises a tray unit 1, a lifting member 2, springs 4, and a lid 3. The lifting member 2 is furnished on a floor part of the tray unit 1 and accommodated in the tray unit 1, and is for lifting the drawing side end of the paper stack 6. The springs 4 are for urging the front end of the lifting member 2 upward. The lid 3 has one end that is pivotably supported on a rear end of the tray unit 1, whereas the paper drawn end thereof is a free end. The lid 3 is formed by bending a metal plate so that a lid plate 30 and side pieces 32, 32, positioned on both right and left sides of the lid plate 30, are furnished integrally; and a round shaft 33, which serves as a pivot, protrudes from the inner side of the rear end of each side piece 32. In the present example, the reverse side of the lid plate 30 has a characteristic feature, as will be described later.

The lifting member 2 is a substantially rectangular-shaped plate extending along the front to back axis, and both rear side ends and both front side ends thereof are finished with claw pieces 21, 21 and 22, 22 protruding therefrom. Each claw piece 21 on the rear ends hangs on the lower face of the tray unit 1.

The tray unit 1 comprises a front wall 11, a rear wall 12, right and left side walls 13 and 14, and a floor plate 15, all of which are integrally formed of a resin. The roller 95 is arranged above the front wall 11.

The tray unit 1 has a size such that it can accommodate paper sheets having a size of 180 mm in length and 123 mm in width (Japanese postcard size), and extends along the front-to-back axis. The paper sheets have about the thickness of postcard.

One side wall 14 is furnished with a plurality of flat spring-like urging members 5 for pushing the paper stack 6 toward the other side wall 13.

Indented steps 13*a* and 14*a* to which the side pieces 32, 32 of the lid 3 are fitted are formed on both outer sides of the side walls 13 and 14. Shaft holes 19, 19, to which the round shafts 33, 33 of the lid 3 fit in from the outside, are formed through the inner sides of the indented steps 13*a* and 14*a* near the rear end, and a recess 19*a* for locking the lid 3 is formed on the inner sides of the steps 13*a* and 14*a* near the front end. Vertical grooves 17, 17, the upper ends of which are closed, are formed in two places on the inner face of the front wall 11, and the claw pieces 22, 22 of the lifting member 2 fit into the vertical grooves 17, 17. The claw piece 22 hits the upper edge of the vertical groove 17, thereby restricting the lifting height of the lifting member 2.

Two incisions 16, 16, into which the claw pieces 21, 21 of the lifting member 2 are fitted, are formed in the floor plate 15, and the lifting member 2 pivots around with the claw pieces 21, 21 being the center.

Two spring sheets 10, 10 are provided at two locations, on the right and the left in a front area of the floor plate 15, and the springs 4 fit into the spring sheets 10, 10.

Reverse Side of the Lid

Figure 4:
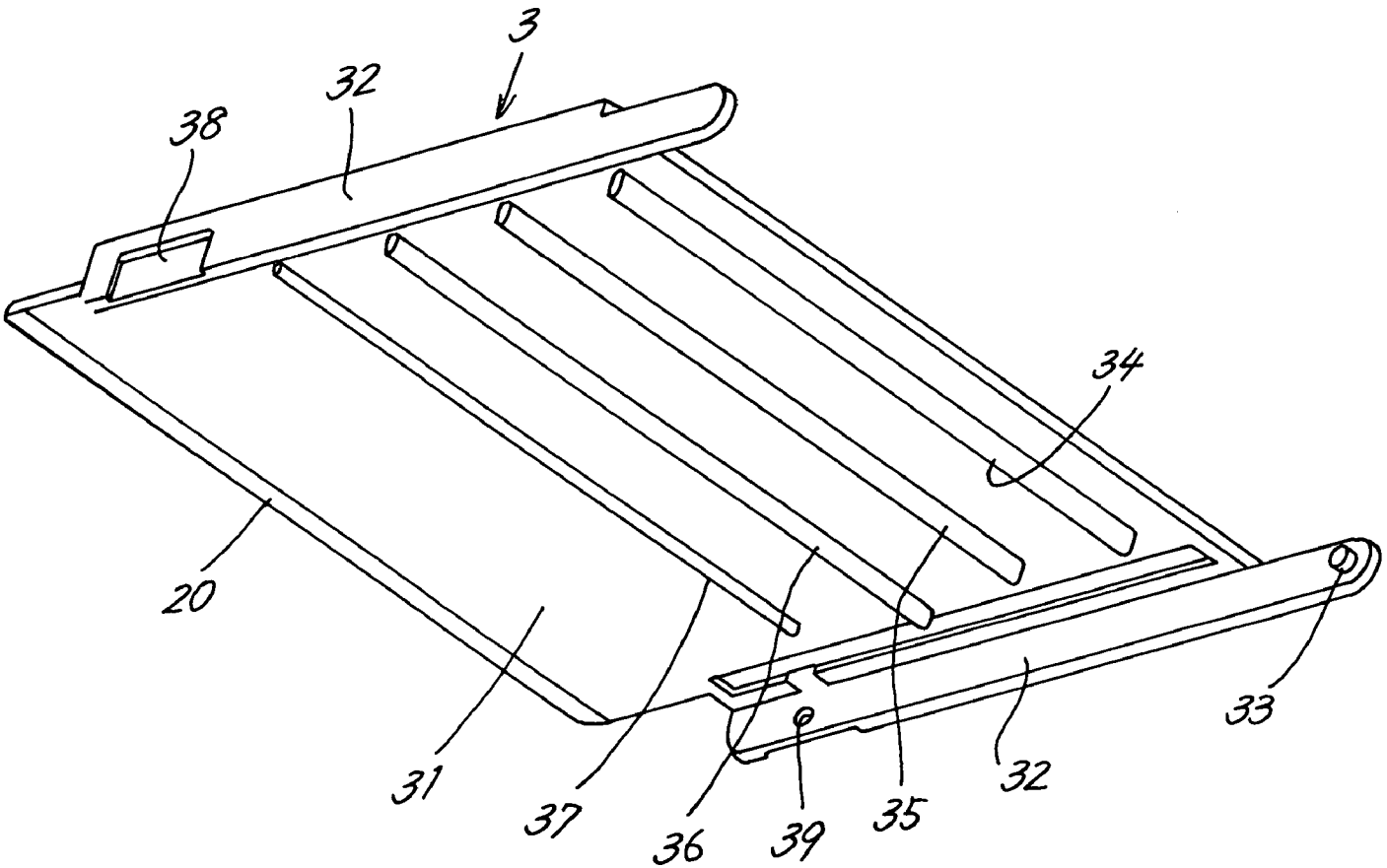
FIG. 4 is a perspective view of a lid, viewed from its reverse side.

FIG. 4 is a perspective view of the lid 3, viewed from its reverse side.

Four protruding parts 34, 35, 36, and 37 that are capable of pressing the paper stack 6 are provided on the lower face of the lid 3 from the pivotal center side to the free end side of the lid 3 at substantially equal intervals. Each of the protruding parts 34, 35, 36, and 37 is a straight-lined protruding part extending along a direction perpendicular to the direction in which paper sheets are drawn out (the direction along the pivotal axis of the lid 3). The fore-ends of the protruding parts 34, 35, 36, and 37 are rounded off in order to prevent them from scratching paper sheets.

The protruding heights of the protruding parts 34, 35, 36, and 37 increase in order of proximity to the pivotal axis of the lid 3. When closing the lid 3, they can push the paper sheets in order from the protruding part 34, which is closest to the pivotal axis of the lid 3.

Immediately before completing the closing of the lid 3, the free end of the lid 3 presses the front end of the paper stack 6 downward against the springs 4. When the lid 3 is closed, the paper stack 6 can be accommodated in the tray unit completely.

In the embodiment, each of the protruding parts 34, 35, 36, and 37 is not in contact with the paper stack 6 in the state in which the paper stack 6 is accommodated completely in the tray unit 1. Specifically, the heights of the protruding parts 34, 35, 36, and 37 are 4 mm, 2.5 mm, 2 mm, and 1 mm, respectively; the interval between the protruding parts is about 20 mm; and the distance between the rearmost protruding part 34, which has the largest protruding height, and the inner face of the tray-unit rear wall 12 is about 42 mm.

Finger-hold recesses 38 are formed on the side pieces 32, 32 near the front, and protuberances 39 are formed protruding from the back of the recesses 38. When closing the lid 3, the protuberances 39 hit the side walls 13 and 14 of the tray unit 1 and thereafter fit into the recesses 19*a* in the side walls 13 and 14 due to the elastic deformation of the resin, causing the lid 3 to be latched softly in a closed state.

When locking the lid 3, the lid plate 30 becomes parallel to the tray unit floor plate 15 and the height of the lid plate 30 is level with the height of the circumferential walls of the tray unit 1.

In addition, the free end of the lid plate 31 is positioned about 8 mm rearward of the front face of the tray-unit front wall 11.

Lid Closing Operation

Figure 5:
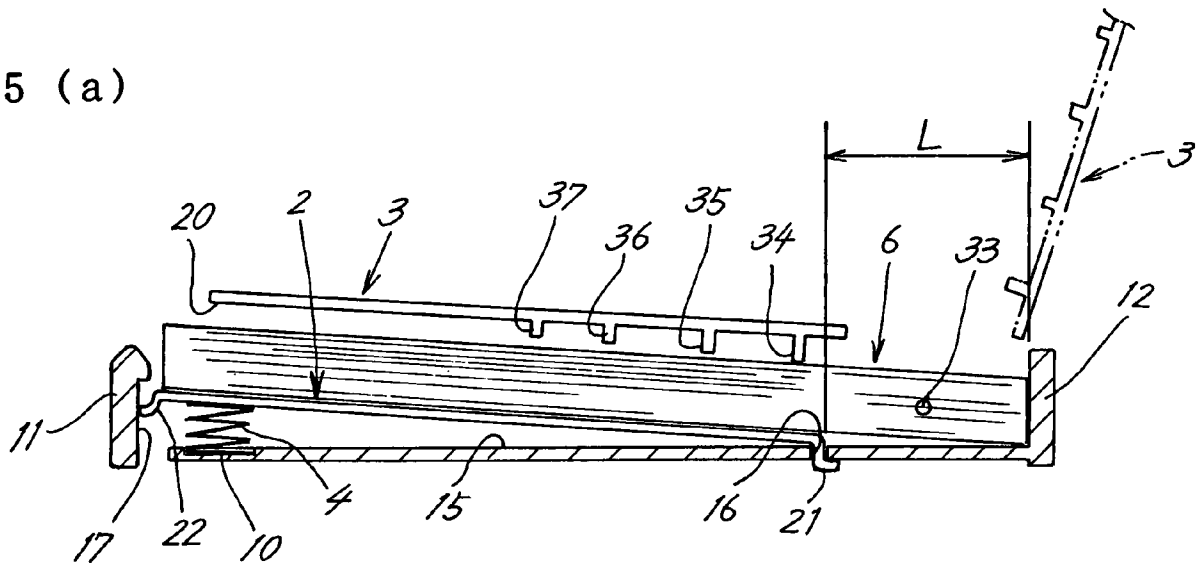
FIGS. 5(*a*) and 5(*b*) are side cross-sectional views illustrating a tray unit, in which a paper stack is accommodated.
Figure 5:
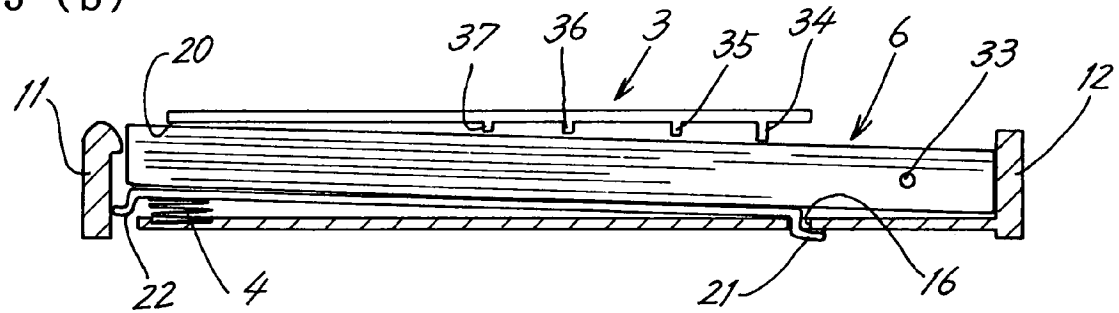

FIGS. 5(*a*) and 5(*b*) are side cross-sectional views illustrating the tray unit 1 in which the paper stack 6 is accommodated. For convenience in illustration, the side pieces 32, 32 of the lid 3 are not shown. Distance L from the inner face of the rear wall 12 to the rear end of the incision 16 is about 45 mm, which is about ¼ of the length of the paper sheets.

To accommodate the paper stack 6 in the tray unit 1, the lid 3 is opened as illustrated in FIG. 5(*a*). One end of the paper stack 6 along its longitudinal sides is put against the inner face of the rear wall 12 of the tray unit 1 to place the paper stack 6 on the lifting member 2.

The force of the springs 4 exceeds the weight of the paper stack 6, and the paper stack 6 tilts together with the lifting member 2. That is, the rear end of the paper stack 6 stays within the tray unit 1, but the front end juts out from the tray unit 1.

Under this condition, the lid 3 is closed as illustrated in FIG. 5(*b*) with the hand. Of the protruding parts 34, 35, 36, and 37 of the lid 3, the protruding part 34 that is closest to the pivotal axis of the lid 3 pushes the rear end of the paper stack 6 downward.

Since the rear end of the paper stack 6 is fitted in the tray unit 1 and the rear end of the paper stack 6 is pushed downward by the protruding part 34, the paper sheets are not misaligned even if an unexpected force is applied to the tray unit 1.

As the lid 3 pivots in the closing direction, the protruding parts 35, 36, and 37 push the paper stack 6 in order of proximity to the pivotal axis of the lid 3. The paper stack 6 gradually fits into the tray unit 1 from the rear-end side.

Just before the lid 3 is completely closed, the free end of the lid 3 holds the paper stack 6. The protruding parts 34, 35, 36, and 37 move away from the paper stack 6.

By locking the lid 3 in a closed condition, the free end of the lid 3 keeps pressing the paper stack 6. Since the protruding parts 34, 35, 36, and 37 are away from the paper stack 6, the drawing resistance is small when the uppermost paper sheet 61 is drawn out by a drawing roller.

The shape, size, arrangement, and number of the protruding parts 34, 35, 36, and 37 may be varied as appropriate according to size of the tray, types of paper sheets, or the like. What is important is that the protruding parts press the rear end of the paper stack 6, which is the rear end that fits into the tray unit 1, before the free end of the lid 3 pushes the paper stack 6.

Providing on the rear end of the lid 3 only one protruding part 34 that can push the paper stack 6 is effective to prevent misalignment of paper sheets.

Alternatively, the protruding part may be formed of such a straight-lined protruding part (not shown) extending along the front-to-rear orientation of the lid 3 that its height gradually decreases from the pivotal axis of the lid 3 toward the free end of the lid 3. If a plurality of such straight-lined protruding parts are provided on both right and left sides of the lid 3 to press both right and left side ends of the paper sheets, misalignment of paper sheets can be prevented more effectively.

Second Embodiment

Figure 6:
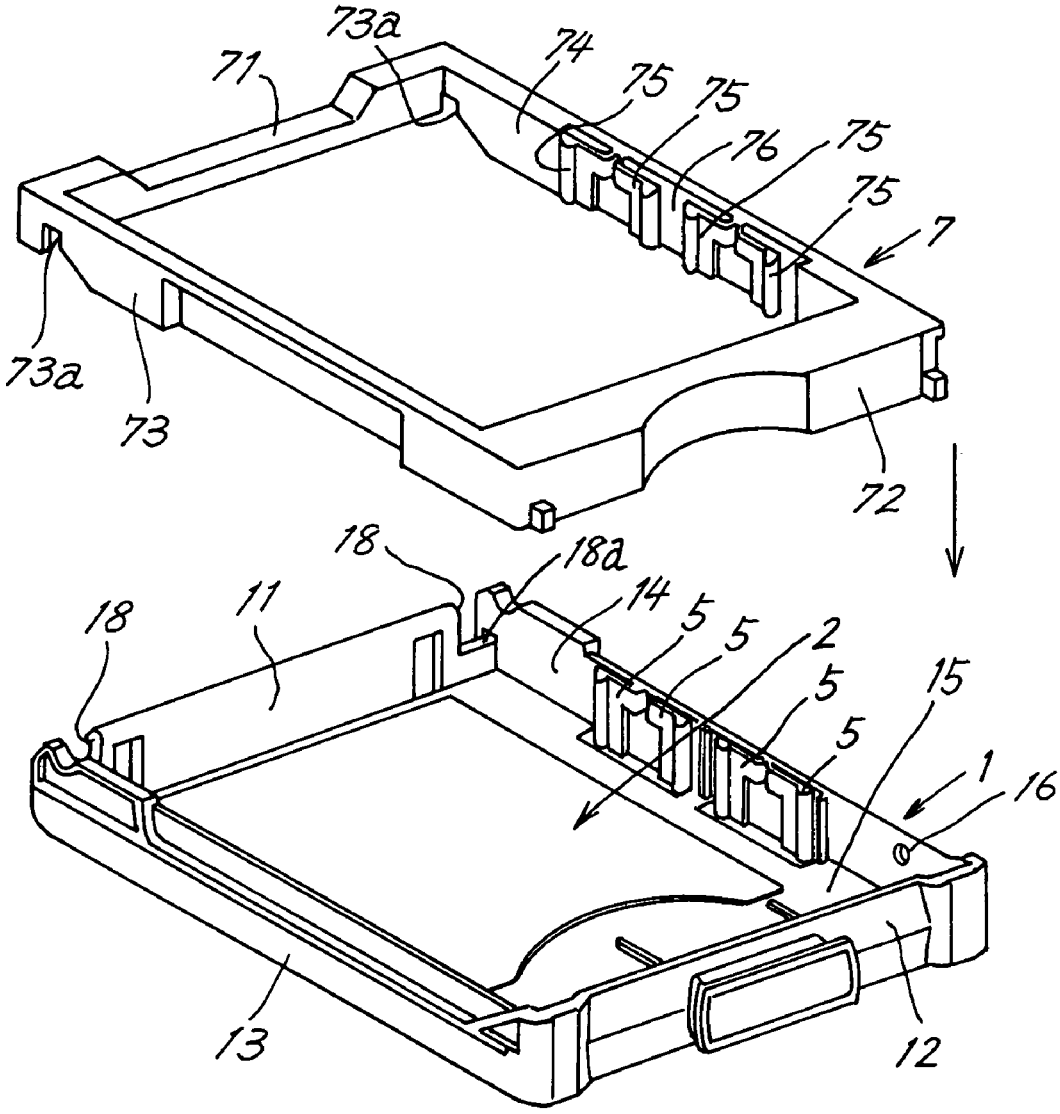
FIG. 6 is a perspective view of an auxiliary tray frame and a tray unit.
Figure 7:
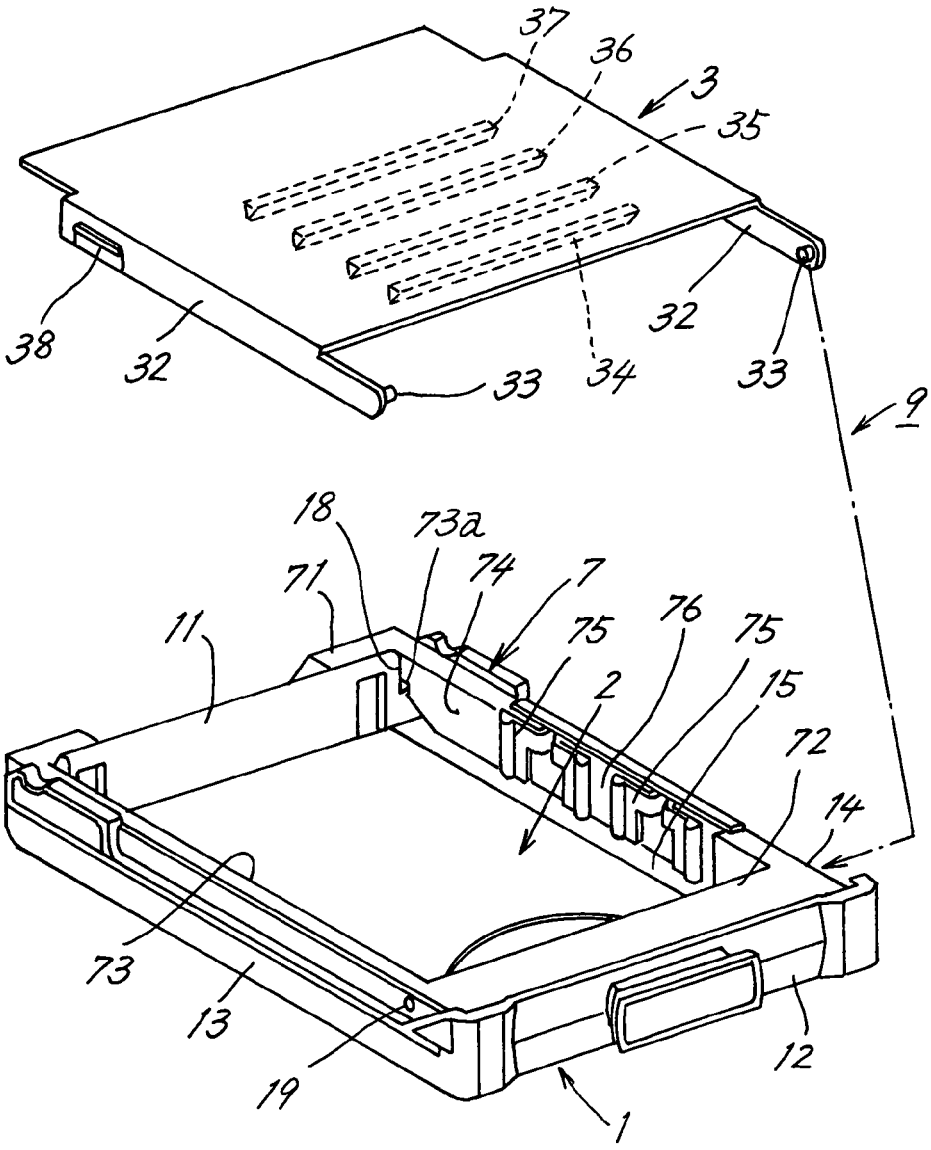
FIG. 7 is a perspective view illustrating a state in which the auxiliary tray frame is mounted in the tray unit.

In the foregoing embodiment, the size of paper sheets is a postcard size, but there are cases in which it is desired to use paper sheets with a size smaller than the postcard size, such as those with a photograph size, for printing. In light of this fact, according to the present embodiment, an auxiliary tray frame 7 adapted for photograph-sized paper sheets can be mounted on the lifting member 2 in a tray unit 1. FIG. 6 is a perspective view of the auxiliary tray frame 7 and the tray unit 1, and FIG. 7 is a perspective view illustrating a state in which the auxiliary tray frame is mounted in the tray unit. In FIGS. 6 and 7, springs 4 are omitted for convenience in illustration. A lid 3 is supported pivotably on the outside of the tray unit 1.

Cut-outs 18, 18 for fitting the auxiliary tray frame 7 are formed in both side ends of a front wall 11.

The auxiliary tray frame 7 is a rectangular frame comprising a front frame portion 71, a rear frame portion 72, and opposing side frame portions 73 and 74. The side frame portions 73 and 74 of the auxiliary tray frame 7 have notches 73*a* near the front end, into which the lower edges of the cut-outs 18 of the tray unit 1 fit. One side frame portion 74 is furnished with a plurality of flat spring-like urging members 75, 75 for pushing a side edge of small-sized paper stack toward the other side frame portion 73. The auxiliary tray frame 7 is pushed toward the side wall 13 by urging members 5 of the tray unit.

In order for the lifting member 2 to support the paper stack 6 stably, it is desirable that the width of the lifting member 2 be as wide as possible. In the embodiment, the lifting member 2 is formed to have a maximum width that does not interfere with the auxiliary tray frame.

As illustrated in FIG. 7, the rear frame portion 72 of the auxiliary tray frame 7 hits the inner face of the rear wall 12 of the tray unit 1 in a state in which the auxiliary tray frame 7 is fitted in the tray unit 1. The fore-ends of opposing side frame portions 73 and 74 fit into the cut-outs 18, 18 of the front wall 11, and the front frame portion 71 of the auxiliary tray frame 7 is located outside the front wall 11.

The space in the auxiliary tray frame 7 that is surrounded by the side frame portions 73 and 74, the rear frame portion 72 and the front wall 11 of the tray unit 1 is a small-sized paper-accommodating region.

In the present embodiment, the protruding parts 34, 35, 36, and 37 of the lid 3 are designed to have such lengths that they do not interfere with the auxiliary tray frame 7, in order for the auxiliary tray frame 7 to be attachable to the tray unit 1. However, if the auxiliary tray frame 7 is provided with grooves or recesses for letting the protruding parts 34, 35, 36, and 37 escape, the protruding parts 34, 35, 36, and 37 may be extended approaching nearer to the side walls 13 and 14 of the tray unit.

In the embodiment, the protruding part 35, one of the protruding parts, is formed to have such a length that an end thereof enters an escape gap 76 between the urging members 75, 75 of the auxiliary tray frame 7.

When the auxiliary tray frame 7 is mounted in the tray unit 1 to feed small-sized paper sheets as well, misalignment of paper sheets is effectively prevented as with the foregoing.

Third Embodiment

Figure 8:
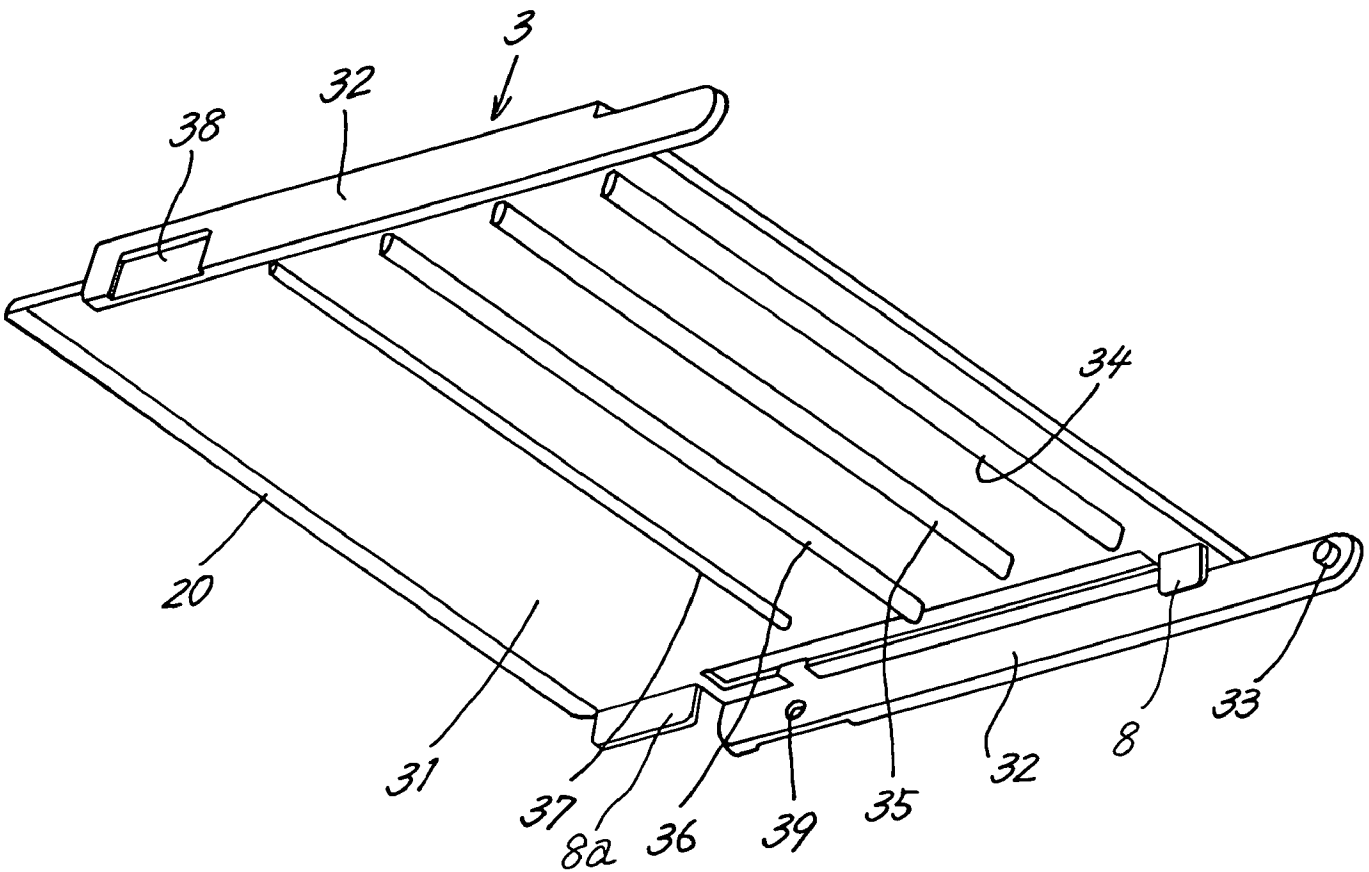
FIG. 8 is a perspective view of a lid of another embodiment, viewed from its reverse side.
Figure 9:
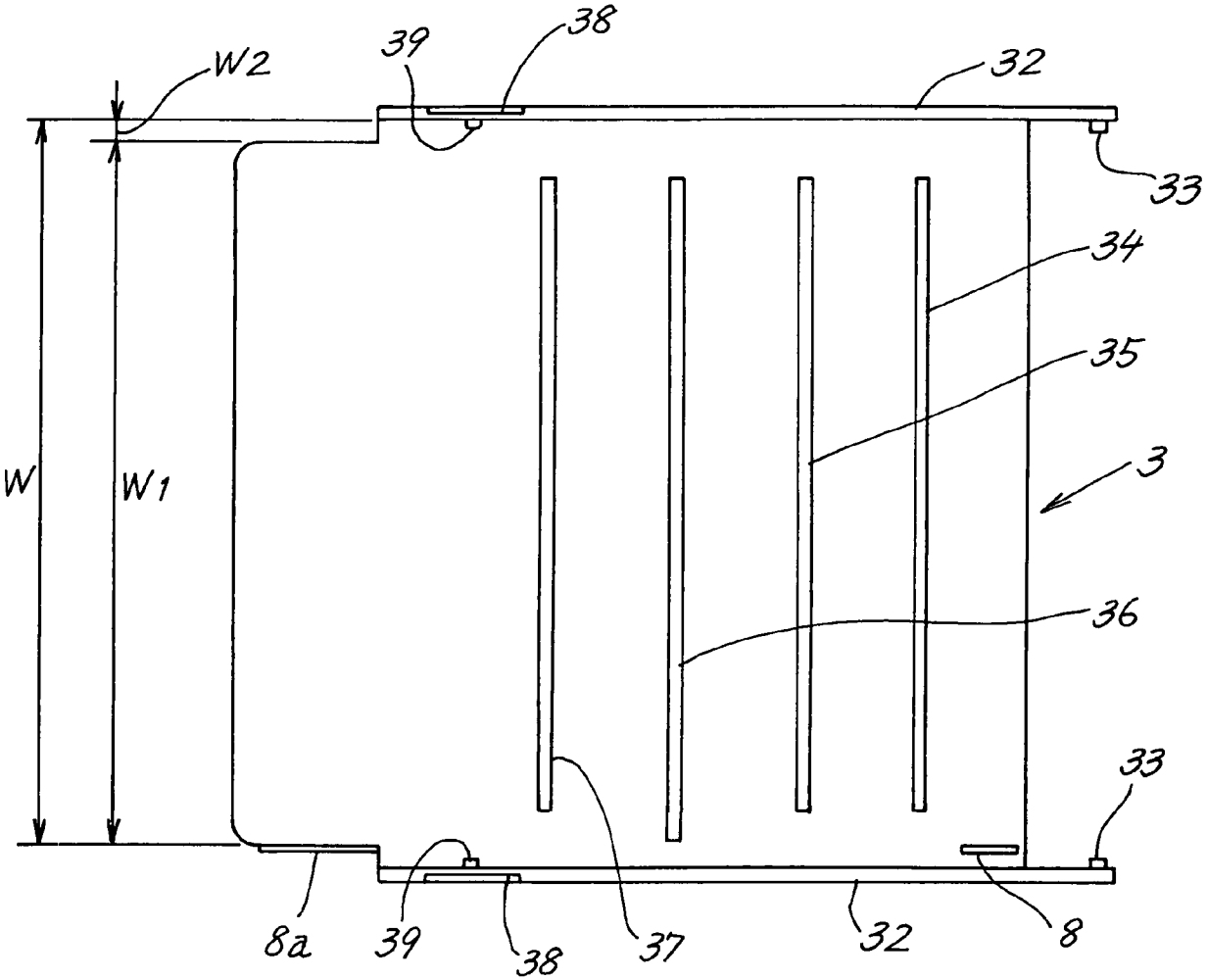
FIG. 9 is a reverse side view of the lid of FIG. 8.

FIG. 8 is a perspective view of a lid 3 according to the present embodiment, viewed from its reverse side, and FIG. 9 is a reverse side view thereof. A characteristic feature of the present embodiment is that protruding pieces 8 and 8*a* for pushing inward the edge of the paper sheets that juts out from the tray unit 1 are provided on the reverse side of the lid 3.

The protruding pieces 8 and 8*a* are provided on the side edge that is on the urging member 5 side, of the side edges perpendicular to the pivotal axis of the lid 3. The protruding pieces 8 and 8*a* are provided at two locations, a pivot axis side and a free end portion of the lid 3, and both are parallel to the side pieces 32.

As illustrated in FIG. 9, the gap W between the protruding pieces 8 and 8*a* and the side piece 32 that is on the far side from the protruding pieces 8 and 8*a* is slightly larger, specifically 0.2 to 0.5 mm larger, than the dimension of the wall thickness W2 of the indented step 13*a* of the tray unit 1, shown in FIG. 3, plus the width W1 of the paper sheet 61.

Figure 10:
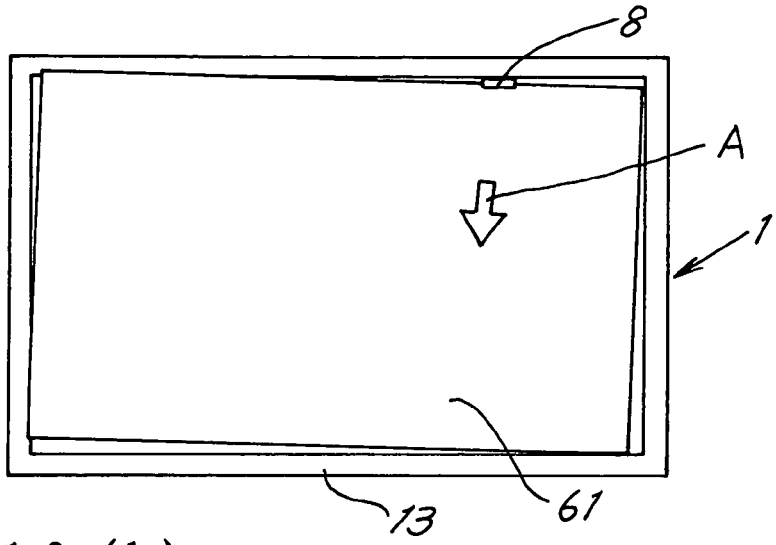
FIGS. 10(*a*), 10(*b*), and 10(*c*) are plan views illustrating a state in which the position of a misaligned paper sheet is corrected.
Figure 10:
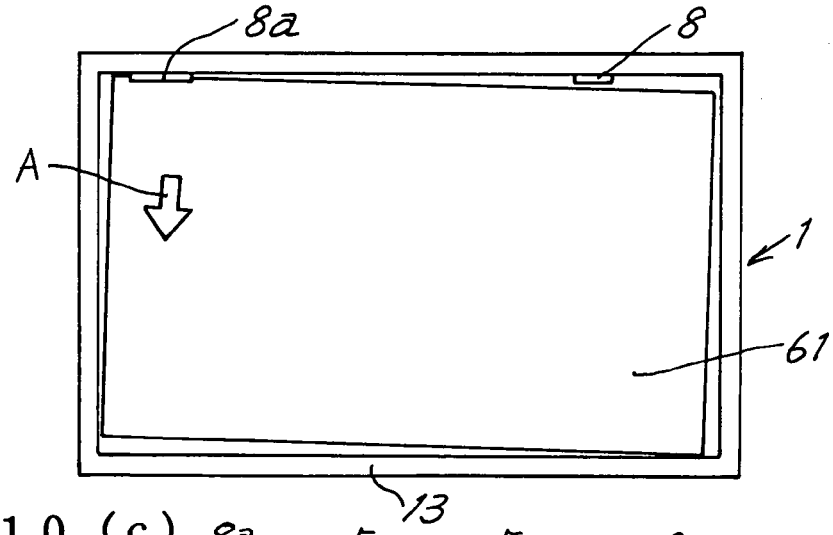
Figure 10:
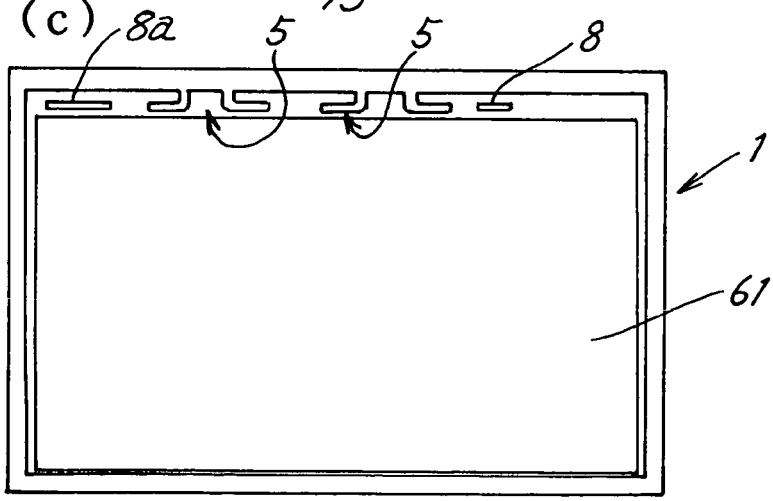

When accommodating a paper stack in the tray unit 1, the uppermost paper sheet 61 often shifts sidewise and juts out from the paper accommodating unit of the tray unit 1, as shown in FIG. 10(*a*).

If the lid 3 is closed in this condition, the protruding piece 8 on the lid 3 near the pivotal axis first hits the paper sheet 61 that tends to jut out while the lid is being closed and pushes the paper sheet 61 downward. The paper sheet 61 is thick and therefore does not bend, and with the edge being pushed by the protruding piece 8, it slides on the paper sheet that is one sheet below. As indicated by arrow A, a force in the direction away from the protruding piece 8 acts on the paper sheet 61. Thus, the uppermost paper sheet 61 pushed by the protruding piece 8 shifts toward the side wall 13 side opposite to the pushing side.

Even if the paper sheet is not aligned properly, the protruding piece 8*a* on the free end side of the lid 3 pushes the side edge of the paper sheet that is on the drawing-out side downward, as shown in FIG. 10(*b*). Thus, a force that pushes the paper sheet 61 in an arrow A direction acts on the paper sheet in a similar manner to the foregoing. The paper sheet 61 shits toward the side wall 13 opposite to the pushing side and is properly aligned by the side wall 13, as shown in FIG. 10(*c*).

When the paper sheet 61 juts out in a large amount, the protruding pieces 8 and 8*a* completely sit over the jutted portion of the paper sheet and do not correct the position of the paper sheet. Nevertheless, when closing the lid 3, it is possible to draw the user's attention because a large resistance occurs that bend the thick paper sheet 61. This prevents setting the paper feed tray 9 without paper sheets being properly set in the paper feed tray 9. It should be noted that the protruding piece 8 and 8*a* may be provided on the side edge that is on the opposite side to that illustrated in FIG. 9 and on the inner face of the lid 3.

It should be noted that the number, location, front-to-rear length of the protruding pieces 8 formed on the lid 3 can be varied as appropriate. It is also possible to provide one protruding piece extending from the front to the rear in substantially a mid portion of a side edge of the lid 3.

In the foregoing embodiments the tray unit 1 is furnished with the springs 4 for lifting the lifting member 2. However, there is a type of paper feed tray in which the lifting member 2 is lifted by a lifting member-elevating mechanism (not shown) provided on the printer side according to consumption of paper sheets. The present invention can also be applied to this type of paper feed tray. Furthermore, the paper feed tray of the present invention can be applied not only to those for printers but also to paper feed trays for photocopiers. A resilient member such as sponge can be used instead of the springs 4.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A paper feed tray comprising:

a tray unit;

a lifting member arranged in the tray unit, for lifting a drawn-out end of a paper sheet being the uppermost of a stack of paper sheets accommodated in the tray unit;

a spring for urging the lifting member in a lifting direction; and a lid, having a lid plate, opposite side edges and shafts for pivoting thereof, attachable to and pivotable on the tray unit about a pivotal axis of the shafts and having a free end where paper sheets are drawn out, wherein the lid has a plurality of protruding parts capable of pressing on a paper sheet being the uppermost of the stack of paper sheets accommodated in the tray unit and arranged on the inner face of the lid at intervals from a pivotal axis side toward the free-end side of the lid;

the plurality of the protruding parts are extending along the pivotal axis side of the lid, so that while the lid is being closed the protruding parts, in order from the one closest to the pivotal axis of the lid, press on the paper sheet and in a state in which the lid is closed the free end side of the lid presses on the paper sheet and the plurality of protruding parts are spaced apart from the paper sheet.

2. The paper feed tray according to claim 1 , wherein an auxiliary tray frame for accommodating a paper sheet having a smaller size than a size of the paper sheet that the tray unit accommodates is fitted into the tray unit.

3. The paper feed tray according to claim 1, wherein, of two side edges of the lid that are perpendicular to the pivotal axis side of the lid, one of the side edges is furnished with a protruding piece for pushing an edge of a paper sheet jutting out from a stack-accommodating portion of the tray unit to stow the paper sheet inside the stack-accommodating portion.

4. The paper feed tray according to claim 3, further comprising protruding pieces provided in a location adjacent the pivotal axis side of the lid and along the free end of the lid.

5. A printer comprising a paper feed tray according to claim 1 and a roller for drawing out paper sheets from the paper feed way.

* * * * *